United States Patent [19]

Dilo

[11] 4,241,479

[45] Dec. 30, 1980

[54] NEEDLE FELT MACHINE WITH A GUIDING APPARATUS FOR THE NEEDLE BEAM

[76] Inventor: Richard Dilo, Stettinerstrasse 28, 6930 Eberbach (Neckar), Fed. Rep. of Germany

[21] Appl. No.: 912,556

[22] Filed: Jun. 5, 1978

[30] Foreign Application Priority Data

Jun. 3, 1977 [DE] Fed. Rep. of Germany ... 7717626[U]

[51] Int. Cl.[3] ..... D04H 18/00

[52] U.S. Cl. ..... 28/107

[58] Field of Search ..... 28/107; 112/79 R; 74/25, 89.18

[56] References Cited

U.S. PATENT DOCUMENTS

| | | | |
|---|---|---|---|
| 2,177,604 | 10/1939 | Stone | 28/107 |
| 3,696,683 | 10/1972 | Jensen | 74/89.18 X |

FOREIGN PATENT DOCUMENTS

| | | | |
|---|---|---|---|
| 2000617 | 7/1971 | Fed. Rep. of Germany | 28/107 |
| 1257669 | 12/1971 | United Kingdom | 28/107 |

*Primary Examiner*—Robert Mackey

*Attorney, Agent, or Firm*—Sherman & Shalloway

[57] ABSTRACT

Needle felt machine in which the needle beam worker arm is articulated on a supporting bearing.

4 Claims, 9 Drawing Figures

NEEDLE FELT MACHINE WITH A GUIDING APPARATUS FOR THE NEEDLE BEAM

The invention relates to a needle felt machine comprising a guiding apparatus for the needle beam, whereby the needle beam is propelled via stroke eccentrics with connecting rods.

As a result of the propulsion of the needle beam via stroke eccentrics, it is put into an up and down motion, whereby the needle beam is guided within the scope of this motion. Circular guide means are known for example but they cause considerable heating, lubricating and sealing problems. Moreover, these guide means have considerable wear and cannot be readjusted in case of wear, so that the mechanical engineering investment is considerable, particularly at high numbers and lengths of strokes. Flat guide means also are known where likewise considerable heating, lubricating and sealing problems occur, and in addition their rate of wear is high. These guide means are inappropriate for high stroke numbers and great stroke lengths. Moreover, guide means working via levers and steering means are known, whereby in this type of guide means the beam carries out a circular arcuate movement which has unfavorable repercussions, particularly at large stroke lengths on the movement of the needle beam, as the fleece material thereby is twisted.

The invention is based on the problem of avoiding the drawbacks of the prior art designs and to propose in particular a needle felt machine which is appropriate for high stroke numbers and large stroke lengths.

According to the invention, this problem is solved in that at least at both sides of the beam, a rocker arm is articulated and that at the machine frame, in each case, a supporting bearing is provided at which the other end of the rocker arm rolls or pivots.

An advantageous embodiment is characterized by the fact that the supporting bearing has a recess in the shape of a tooth gap in which a tooth mounted at the rocker arm rolls.

It is, moreover, advantageous that the supporting plane has a rolling slab in a plane staggered in relation to the tooth gap on which a rolling part of the rocker arm pivots, whereby the rolling circle of the sprocket wheel associated with the tooth corresponds with the rolling circle of the rolling part.

The invention offers the essential advantage that a needle felt machine is proposed with a guiding apparatus for the needle beam which assures a precise rectilinear upward and downward movement of the needle beam without any heating, lubricating and sealing problems or any high rate of wear being encountered. The needle machine according to the invention is particularly appropriate at high numbers of strokes and great stroke lengths. In addition, this embodiment distinguishes itself by its simple constructive design. The invention will be explained more in detail in the following description, based on an embodiment exemplified in the drawings in which:

FIG. 4 shows a perspective view of the supporting bearing.

Figure 1:
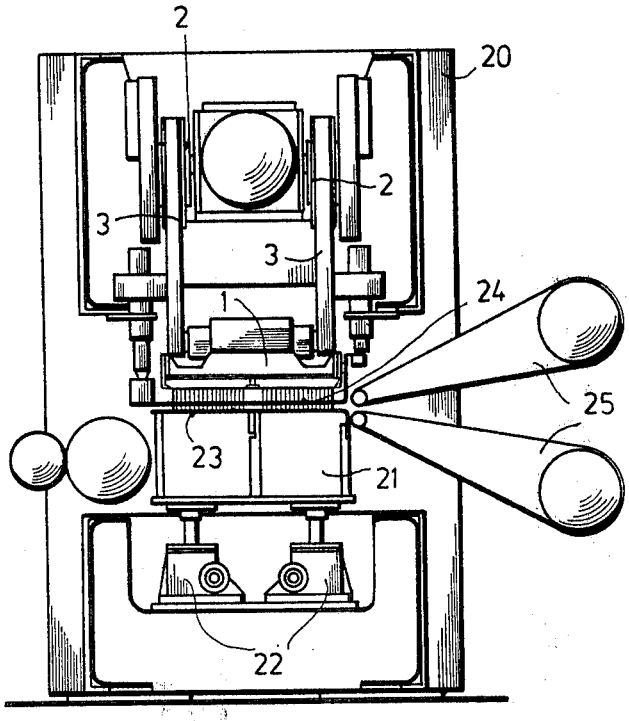
FIG. 1 shows a needle machine with the innovation in elevation.
Figure 2:
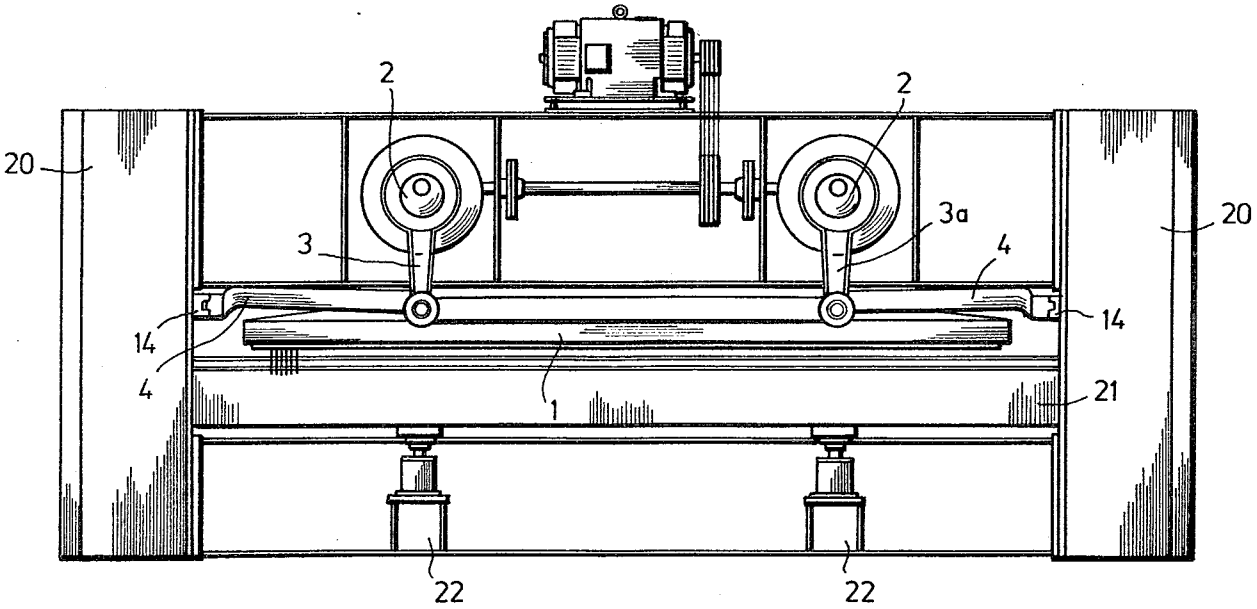
FIG. 2 shows a lateral view of FIG. 1.

The needle machine represented in FIGS. 1 and 2 comprises a machine frame 20, where on the bottom the table 21 is supported and vertically adjustable via lifting devices 22. A grate 23 is placed on the table through which the needles of the superposed needle beam 1 can pass. The needle beam 1 is suspended by laterally positioned pairs of connecting rods 3, 3*a* which generate via stroke eccentrics 2 an oscillating movement of the needle beam 1. Moreover, a hold-down plate 24 is located between the needle beam 1 and the grate 23. Feed means 25 for the material to be processed are provided at the infeed of the machine.

Two or more rocker arms 4 are used to guide the beam 1 and they are arranged opposite each other, that is on both sides of the connecting rods 3 and 3*a*. The rocker arm 4 has two pivoting means or points, whereby one end pivot point 5 is articulated via a bearing 5*a* at the beam 1 while the other end pivot point 6 of the rocker arm 4 is maintained in a supporting bearing 14, where it can pivot accordingly. This supporting bearing 14 is mounted on the machine frame 20. A sprocket wheel or gear design is used as supporting bearing 14 by providing a tooth recess "R" into which the end 6 of the rocker arm 4 engages via a tooth member "T" 8. It is appropriate to provide an involute tooth system in which a recess is located in the portion of the bearing means 14 which is carried on the arm 4. Moreover, the supporting bearing has a flat roller plate 10 which is arranged in a plane staggered or offset in relation to the sprocket wheel plane forward or rearward, whereby on this roller plate 10 a mating, curved rolling part 9 of the rocker arm 4 rocks on the pitch circle of the gear assembly. This function is comparable to a sprocket wheel which is moved upward or downward by a rack, whereby the center of the sprocket wheel corresponds to the pivoting point at 5.

Figure 3:
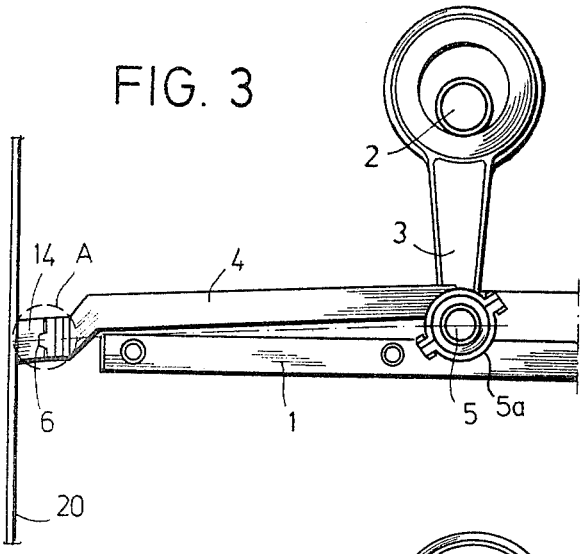
FIGS. 3 to 5 show a partial view of an apparatus according to the invention at various positions of the needle beam.
Figure 6:
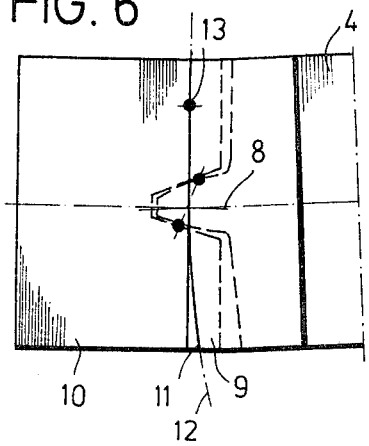
FIGS. 6 to 8 show an enlarged view of the supporting bearing commensurate with the positions in FIGS. 3 to 5, respectively.
Figure 4:
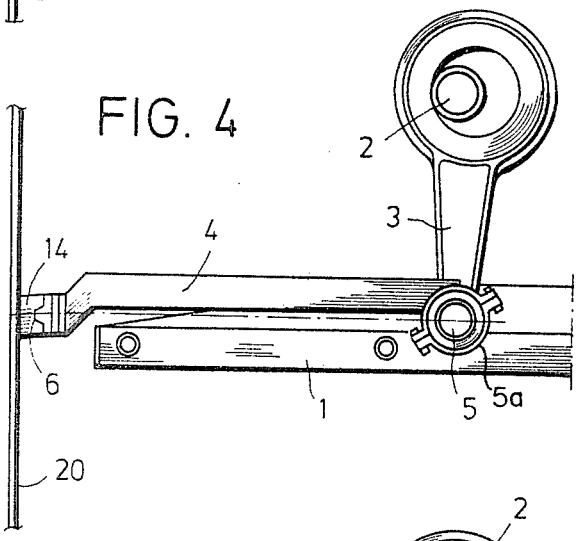
Figure 7:
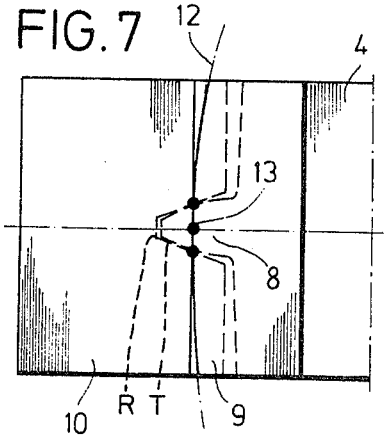
Figure 5:
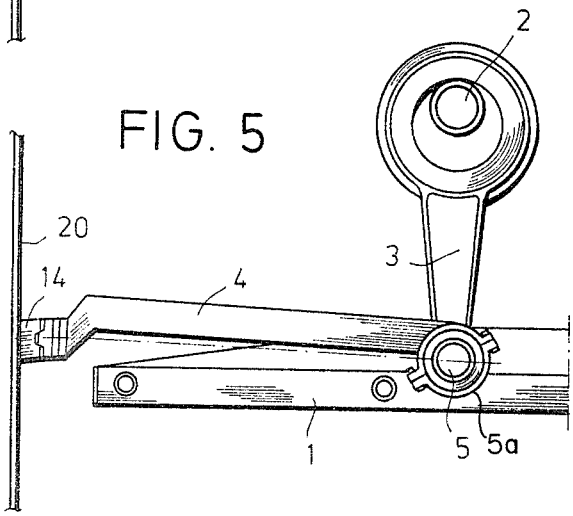
Figure 8:
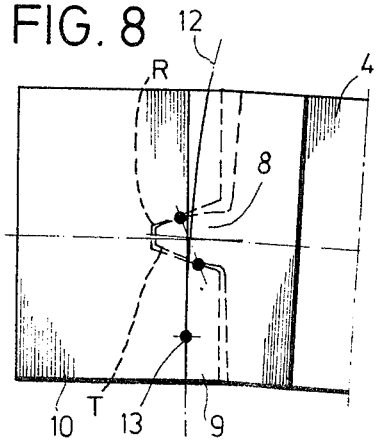
Figure 9:
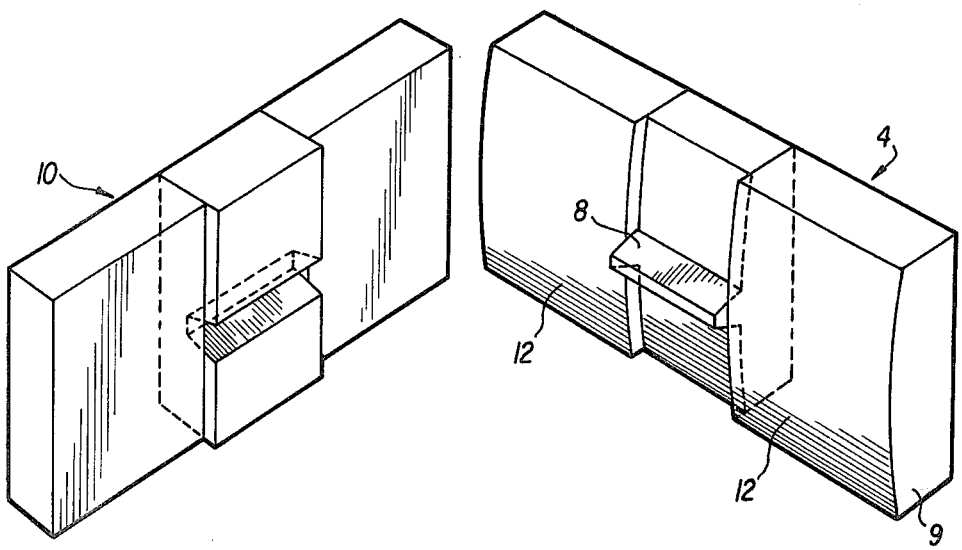

FIGS. 3 and 6 show the position of the rocker arm 4 at the upper dead center of the beam, FIGS. 4 and 7 show the central position of the beam and FIGS. 5 and 8 show the position at the lower dead center. Various rolling circles and rolling points are plotted in FIGS. 6 to 8, including the rolling surface 11 of the pitch part 9, and rolling circle 12 of the tooth arrangement. 13 is the moving point of load contact of the rolling surface 11 and the flat rolling plate 10. Thereby, the tooth arrangement 8 assures, by the involute serration, free rolling or pivotal action, while the rolling part 9 with the rolling panel 10 will produce a rolling along the pitch circle 12 and thus, a precise vertical stroke movement of the beam 1 is assured. The rolling surface 11 of the pitch part 9 thus corresponds with the rolling circle 12 of the "sprocket wheel" , while the moving load contact 13 therebetween moves parallel to the path of vertical reciprocation of the needle beam.

I claim:

1. A guiding assembly for the reciprocating needle beam of a needling machine comprising:

(a) at least one pair of rocker arms positioned on opposite sides of said needle beam, each rocker arm including (b) pivoting means adjacent a first end thereof for pivotally engaging said needle beam and (c) pivoting support bearing means adjacent the second end thereof for pivotally engaging a fixed structure, said pivoting support bearing means including (d) a first bearing surface on said fixed structure and (e) a second bearing surface on said second end of said rocker arm;

(f) one of said first and second bearing surfaces being mounted and adapted to roll across the surface of the other of said surfaces along a moving load point changing generally parallel to the path of reciprocation of the needle beam;

(g) one of said first and second bearing surfaces includes an involute gear recess therein and the remaining bearing surface includes a cooperating gear tooth; and (h) one of said first and second bearing surfaces is flat and parallel to the path of reciprocation of the needle beam and in which the remaining bearing surface is arcuate, and the moving load point changes along an arcuate path.

2. A guiding assembly for the reciprocating needle beam of a needling machine comprising at least one pair of rocker arms positioned on opposite sides of said needle beam, each rocker arm including pivoting means adjacent a first end thereof for pivotally engaging said needle beam and pivoting support bearing means adjacent the second end thereof for pivotally engaging a fixed structure, said pivoting support bearing means including (a) a first bearing surface on said fixed structure;

(b) a second bearing surface on said second end of said rocker arm;

(c) at least one of said first and second bearing surfaces being curved;

(d) one of said first and second bearing surfaces being mounted and adapted to roll across the surface of the other of said surfaces along a moving load point causing the moving load point to change generally parallel to the path of reciprocation of the needle beam;

(e) restraining means between the first and second bearing surfaces.

3. A guiding assembly as set forth in claim 2 in which one of said first and second bearing surfaces is flat and parallel to the path of reciprocation of the needle beam and in which the remaining bearing surface is arcuate, and the moving load point changes along an arcuate path.

4. A guiding assembly as set forth in claim 1 or 3 in which the arcuate path of said moving load point coincides with the pitch circle of the rocker arm.

* * * * *